US005558225A

United States Patent [19]

Weisburn et al.

[11] Patent Number: 5,558,225

[45] Date of Patent: Sep. 24, 1996

[54] PHOTOGRAPH AND NEGATIVE STORAGE CONTAINER AND METHOD

[75] Inventors: James T. Weisburn, Massillon; Larry K. Mundorf, North Canton; Roger H. Ramsey, Akron; William E. Brazis, Medina, all of Ohio

[73] Assignee: Alpha Enterprises, Inc., North Canton, Ohio

[21] Appl. No.: 264,964

[22] Filed: Jun. 24, 1994

[51] Int. Cl.[6] ..... B65D 85/48; B65D 85/62; B65B 25/14

[52] U.S. Cl. ..... 206/455; 206/578; 220/505

[58] Field of Search ..... 206/455, 232, 206/578, 214, 224; 220/503, 505; 53/474, 475, 468

[56] References Cited

U.S. PATENT DOCUMENTS

| | | | |
|---|---|---|---|
| 877,078 | 1/1908 | Havenhill et al. | 206/455 |
| 2,112,816 | 3/1938 | Rulon | 206/455 X |
| 3,755,925 | 9/1973 | Court | 206/232 X |
| 3,926,308 | 12/1975 | Sullivan | 206/223 |
| 4,095,694 | 6/1978 | Jost | 206/455 |
| 4,545,486 | 10/1985 | Bostic | 206/455 |
| 4,596,329 | 6/1986 | Eldridge, Jr. | 206/232 X |
| 4,643,301 | 2/1987 | Hehn et al. | 206/232 |
| 4,977,483 | 12/1990 | Perretta | 206/232 X |
| 5,016,752 | 5/1991 | Haugen, Jr. | 206/455 |
| 5,251,745 | 10/1993 | Repp et al. | 206/455 X |
| 5,339,950 | 8/1994 | Li | 206/232 X |

*Primary Examiner*—Horace M. Culver
*Attorney, Agent, or Firm*—Sand & Sebolt

[57] ABSTRACT

A storage container, primarily for photographs and their negatives, is formed as a one-piece member of plastic material. A rectangular housing is formed by a base and pairs of parallel spaced sidewalls and end walls. A flat panel is pivotally mounted on the base and swings into the housing to form a first storage compartment with the base for receiving the negatives. The photographs are placed on the panel and are retained in the container by a closure lid which is pivotally mounted on one of the end walls of the housing opposite of the pivotal mounting of the panel. The lid is moved into a spaced parallel juxtaposition with the panel to a closed, latched position forming a second storage compartment between the panel and lid for storing the photographs. Printed indicia is placed on an inclined end wall of the lid to identify the contents of the container. A partition on the panel enables the second storage compartment to store two stacks of 3 ½×5 photographs or one stack of 4×6 photographs.

15 Claims, 3 Drawing Sheets

PHOTOGRAPH AND NEGATIVE STORAGE CONTAINER AND METHOD

BACKGROUND OF THE INVENTION

1. Technical Field

The invention relates to a storage container and associated method for storing objects, and particularly for storing photographs and negatives in a compact container for ease of storage and viewing. More particularly, the invention relates to such a container which will store different sizes of photographs in a first compartment and the related negatives in a second compartment.

2. Background Information

An individual when obtaining finished photographs will also receive the negatives, both of which are usually placed in an envelope. In most instances, the negatives are misplaced after the photographs have been reviewed or stored separate from the photographs making them difficult to locate in the future when additional prints are required. Very often the photographs are placed in an album and labeled to enable the observer to easily retrieve the photographs by subject matter for subsequent reviewing and showing to friends and relatives. However, the negatives are very seldom kept in the album and are usually placed in a separate drawer or other remote location, and in most instances will become lost or misplaced.

One type of container which has been developed for storing both the photographs and negatives is shown in U.S. Pat. No. 5,016,752. The container of this patent also recognizes that photographs come in various sizes for example 3 ½×5 and 4×6 being the most common sizes. Thus, this prior art container provides provisions for different size photographs by providing removable tabs to enable the container to accommodate both standard sizes of photographs. However, once the tabs are removed for the larger size photos, they cannot be conveniently or satisfactorily used for the smaller 3 ½×5 print size. Furthermore, the negatives are exposed and can become dislodged from their storage in the lid upon the repeated opening and closing of the lid.

Therefore, the need exists for an improved storage container for objects, and in particular for photograph prints and their negatives which will enable the two standard size photographs to be selectively stored in the container as well as the negatives in a safe secured condition.

SUMMARY OF THE INVENTION

Objectives of the invention include providing an improved storage container for photographs and their negatives in a convenient, safe and secured container; and in which the negatives are maintained in a normally closed storage compartment which needs not be opened or disturbed when the container is opened and closed for viewing the photographs stored therein.

A further objective is to provide such a storage container which will accommodate both standard size photographs, for example the 3 ½×5 and 4×6 size selectively without requiring any particular manipulation of the container; and in which the larger size photograph of 5×7 can be stored in the negative storage compartment if desired.

Still another objective of the invention is to provide such a storage container which can be mass produced relatively inexpensive of a transparent or translucent plastic material as an integral one-piece member.

A further objective of the invention is to provide such a storage container having a sloped end wall which is adapted to contain printed information such as the subject matter covered by the photographs stored therein; and in which the sloped end wall enables a rapid viewing of the identifying indicia without opening or moving the containers from their stored positions when a plurality of such containers are placed in a drawer or storage rack.

Another objective is to provide such a storage container which is of a simple, rugged and inexpensive construction, yet which provides a relatively dust free storage container for various size photographs and their negatives; and in which the container can be latched and unlatched easily without excessive manipulation of the latching mechanisms.

These objectives and advantages are obtained by the improved storage container of the invention, the general nature of which may be stated as including a base; panel means pivotally mounted with respect to the base and movable into spaced juxtaposition with said base for forming a first storage compartment between said base and panel; and lid means pivotally mounted with respect to the base and movable into a closed position on the base in spaced juxtaposition with the panel means for forming a second storage compartment between said panel means and lid means.

These objectives and advantages are further obtained by the improved method of the invention, the general nature of which may be stated as a method for storing objects in a container wherein said container includes a housing and a panel and lid pivotally mounted on opposite ends of said housing; said method including the steps of placing a first object in the housing; pivotally moving the panel to a closed position to form a first storage compartment and to secure the first object therein; next placing a second object on top of the panel; and then pivotally moving the lid into a closed position on the housing to form a second storage compartment containing the second object.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
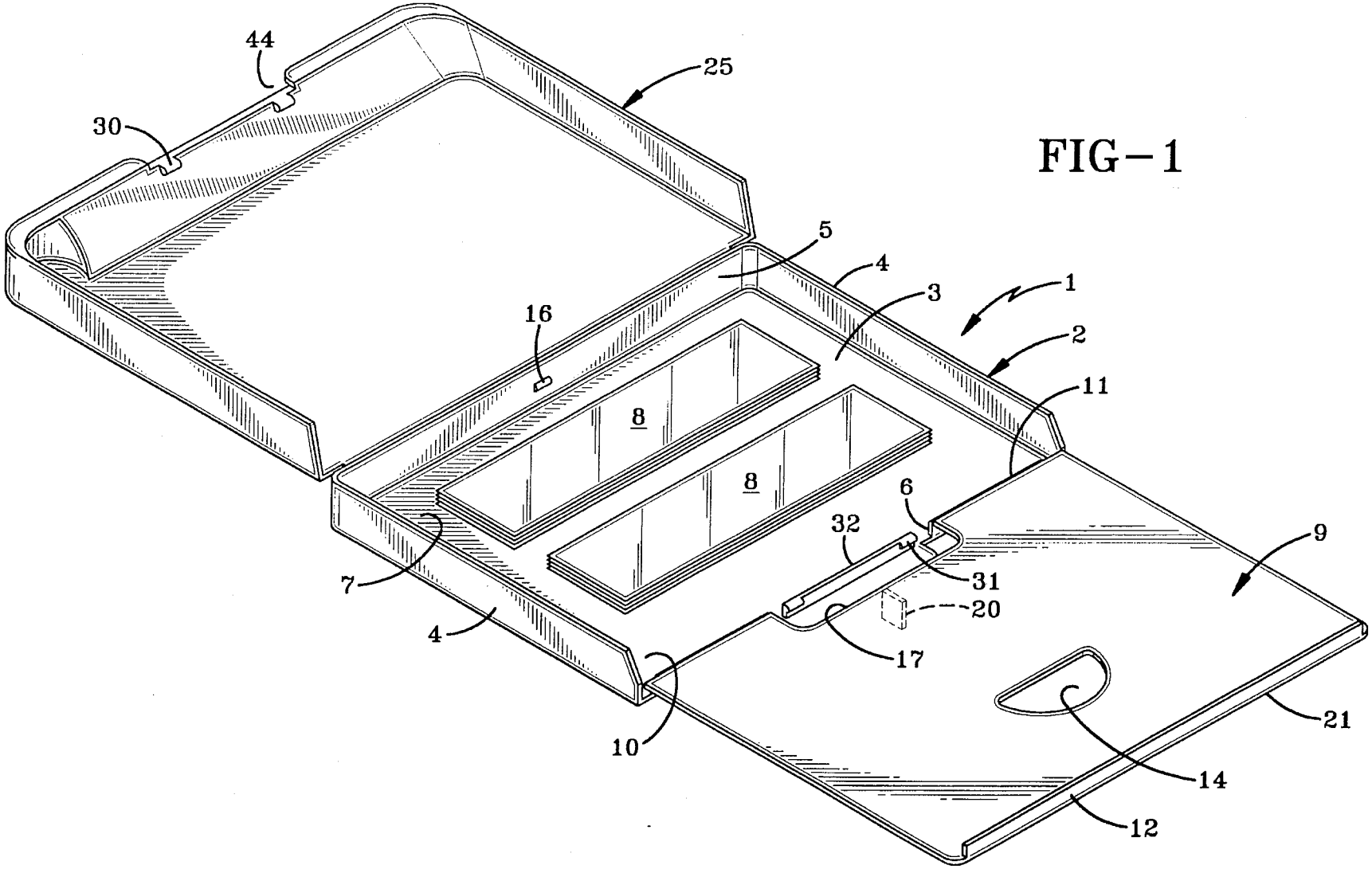
FIG. 1 is a perspective view showing the storage container in a full open position with two stacks of negatives in the negative storage compartment thereof.

The storage container of the present invention is indicated generally at 1, and preferably is formed of a one-piece plastic member which includes a box-like housing indicated generally at 2. Housing 2 is formed by a flat planar base 3 and a pair of spaced parallel sidewalls 4, generally of equal height, and spaced end walls 5 and 6. End wall 5 is the same height as sidewalls 4 with end wall 6 being approximately ⅓ the height thereof. Walls 4, 5 and 6 form a rectangular storage compartment 7 adapted to store a plurality of negatives 8 or other types of relatively flat objects.

Figure 4:
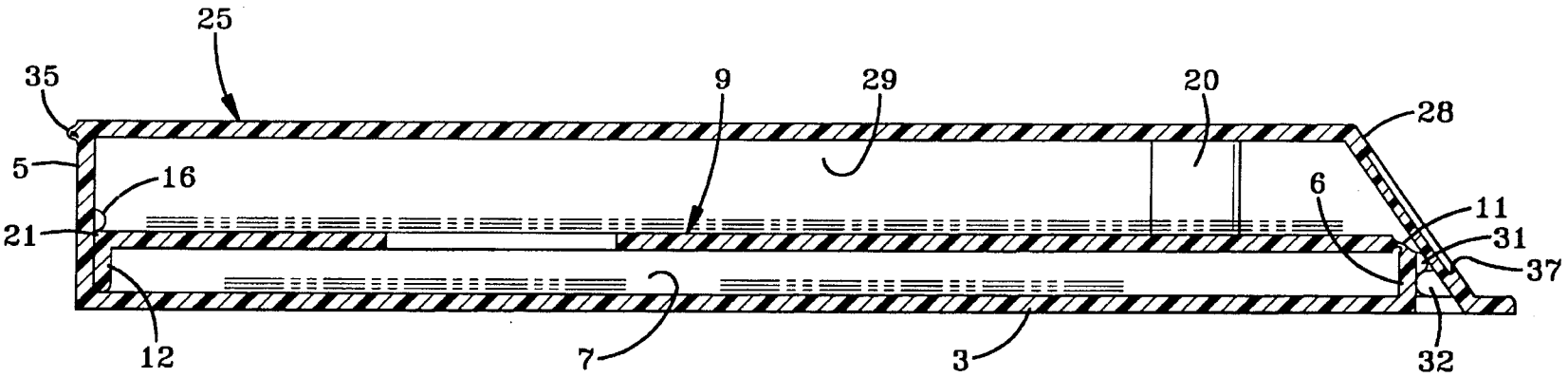
FIG. 4 is an enlarged sectional view taken on line 4—4, FIG. 3.

A flat panel indicated generally at 9, is hingedly mounted to the top of end wall 6 as shown in FIG. 4, by a living hinge 11. Panel 9 includes an end wall 12 opposite of hinge 11, which is approximately the same height as end wall 6 of housing 2. Panel 9 is sized to the general dimension of the interior of storage compartment 7 defined by walls 4, 5 and 6. A crescent-shaped opening 14 is formed in panel 9 to enable a user to grasp panel 9 and move it from the closed position of FIG. 2 to its open position of FIG. 1.

Figure 2:
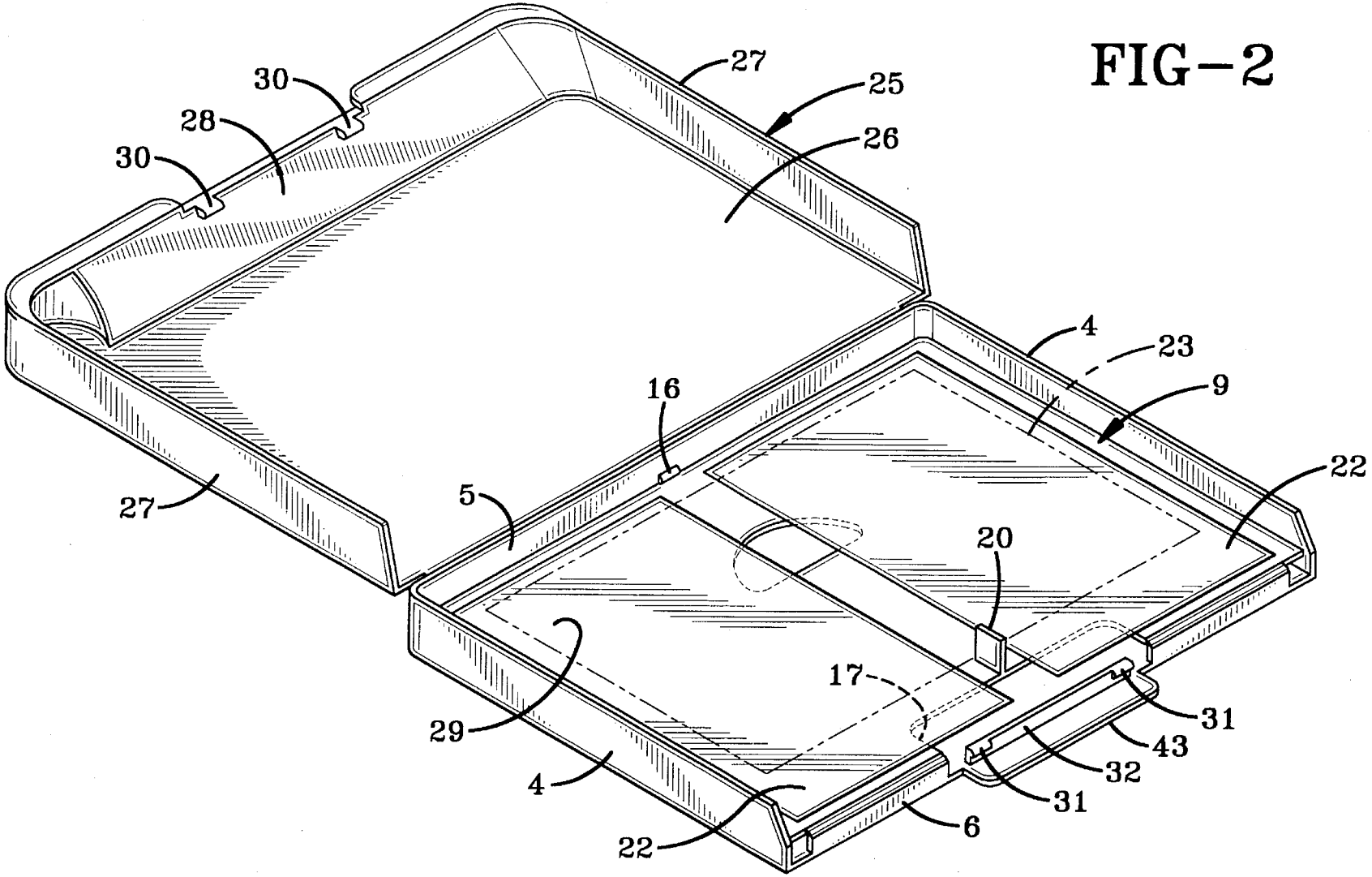
FIG. 2 is a perspective view similar to FIG. 1 with the negative storage compartment shown in a closed position and with two stacks of 3 ½×5 photographs being shown in full lines and with a 4×6 photograph being shown in dot-dash lines in a stored position in the photograph storage container.

A small nub 16 is formed integrally on end wall 5 and functions as a latch as shown in FIG. 2, to removably latch panel 9 in its closed position. Panel 9 is also formed with a U-shaped cutout 17 at an inner edge thereof and divides the living hinge 11 into two equal hinge sections. A small partition tab 20 is formed on the top surface of panel 9, when viewing panel 9 in its closed position of FIG. 2, adjacent U-shaped notch 17 and projects upwardly therefrom.

As shown in FIG. 1, negatives 8 are placed in storage compartment 7 and are retained therein upon the pivotal movement of panel 9 from the open position of FIG. 1 to the closed position of FIG. 2 wherein panel 9 is in a spaced juxtaposition with base 3 and parallel therewith. As indicated above, nub 16 engages the front edge 21 formed at the junction of panel 9 and end wall 12, to form a snap-fit latching engagement therewith.

Referring to FIG. 2, partition 20 enables two stacks of 3 ½×5 photographs 22 to be stored on top of closed panel 9 as shown in full lines in FIG. 2, or permit the storage of a single stack of 4×6 photographs 23, which are shown in dot-dash lines in FIG. 2 in a second storage compartment 29 which is formed adjacent storage compartment 7. It is possible to store both sizes of photographs in storage compartment 29, preferably after first separating them into their respective sizes and stacks.

Figure 3:
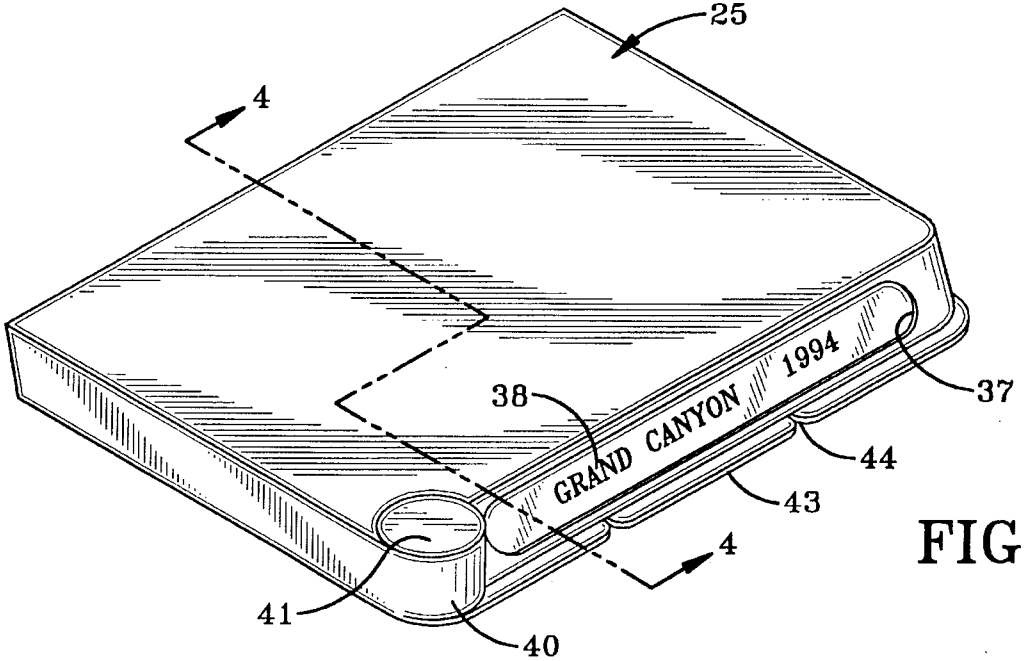
FIG. 3 is a perspective view similar to FIGS. 1 and 2, with the storage container in its full closed position.

After placement of either or both sizes of photographs in compartment 29, as shown in FIG. 2, a closure lid indicated generally at 25, is moved from its open position of FIG. 2 to its closed position of FIGS. 3 and 4. Lid 25 includes a flat planar top wall 26 and spaced parallel sidewalls 27 and an end wall 28. Lid 25 is sized so that end walls 27 when in the closed position as shown in FIGS. 3 and 4, will lie along and closely adjacent to and outside of, base sidewalls 4 to provide a generally dust free interior for housing 2. A pair of nubs 30 are formed integrally on the inside surface of end wall 28 and snap-fittingly engage a similar pair of nubs 31 which are formed on an elongated upstanding projection 32 which is formed at the end of base adjacent U-shaped cutout 17 of panel 9. Nubs 31 releasably secure lid 25 in its closed position as shown in FIG. 3 and 4. Lid 25 is connected to the top of base end wall 5 by a living hinge 35 (FIG. 4), in a similar manner as is panel 9 hingedly connected to base 3.

In accordance with another feature of the invention, end wall 28 is inclined and is provided with an elongated recess 37 (FIG. 3) which may contain a label 38 having printed indicia thereon to identify the contents of the photographs stored therein. A small circular boss 40 also may be formed adjacent one corner of end wall 28 to provide a flat area 41 for containing additional printed indicia, such as a number, or possibly the manufacturers trademark.

An outwardly projecting elongated tab 43 is formed integrally with base 3 and extends outwardly from latching projection 32 and generally aligns with and lies within a cutout 44 formed in the edge of end wall 28 as shown in FIGS. and 2. This configuration enables storage container 1 to be easily opened by an individual's thumb and index finger merely exerting a slight twisting motion on tab 43 and the adjacent exposed ends of base 3 which will disengage nubs 30 and 31 enabling lid 25 to be moved easily from its closed position of FIGS. 3 and 4 to the open position of FIGS. 1 and 2 on hinge 35.

In accordance with another feature of the invention, a larger size photograph, for example 5 x 7, could be stored within the first storage compartment 7 with negatives 8, with the 3 ½×5 and 4×6 sizes being stored in second storage compartment 29.

In summary, a user will either place a stack of negatives 8 or large photographs for example 5×7 (not shown) in first storage compartment 7, afterwhich panel 9 is pivotally moved to its closed position as shown in FIGS. 2 and 4 wherein panel 9 lies in spaced parallel juxtaposition with base 3 to form the first storage compartment 7 therebetween. Next, the 3 ½×5 or 4×6, or both sizes of photographs, are placed in second storage compartment 29 on top of closed panel 9 as shown in FIG. 2, afterwhich lid 25 is moved to its closed position as shown in FIG. 4, wherein lid 25 lies in a spaced parallel juxtaposition with panel 9 in forming second storage compartment 29. Tab 20 as indicated previously divides storage compartment 29 into two sections enabling it to hold two stacks of 3 ½×5 photographs.

Panel 9 merely snaps into its closed position by passing of panel edge 21 past nub 16. Likewise lid 25 also moves easily into a latched position by the snap engagement of nubs 30 and 31.

The inclined configuration of end wall 28 enables the printed indicia to be viewed easily if a plurality of storage containers 1 are stacked one on top of the other or even when placed on their edges in an upstanding abutting relationship with each other in a drawer or storage container.

As shown in FIG. 4, end wall 6 of panel 9 is sized so as to rest on base 3 when in its closed position to provide for the spaced parallel relationship of panel 9 with base 3 in forming storage compartment 7 as well as forming the bottom portion of storage compartment 29.

The use of living hinges 11 and 35 for the pivotal mounting of panel 9 and lid 25, respectively, on opposite ends of housing 2, as well as the formation of the latching nubs and partition 20, integrally with the respective components thereof of housing 2, enables container 1 to be formed as a one-piece member, preferably of a polypropylene plastic material. This construction avoids additional components that must be assembled on the container, which also are subject to breakage and loss.

Although the improved storage container is intended primarily for storing photographic prints and their negatives, it conceivably could be used for storing other generally flat items in the two spaced storage compartments arranged in a stacked configuration. Likewise, the storage container preferably is formed of a material having sufficient transparency to enable some of the contents to be visible although the walls, although such transparency is not required since the label on end wall 28 provides rapid identification of the contents stored therein.

Accordingly, the improved storage container is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved storage container is constructed and used, the characteristics of the construction, and the advantageous, new and useful results obtained; the new and useful structures, devices, elements, arrangements, parts and combinations, are set forth in the appended claims.

We claim:

1. A storage container for objects including a base having first and second spaced end walls;

panel means pivotally mounted on the second end wall of the base and movable into spaced juxtaposition with said base and extending to adjacent said first end wall for forming a first storage compartment between said base and panel means and extending between said first and second end walls; and lid means pivotally mounted on the first end wall of the base and movable into a closed position on the base and extending to adjacent said second end wall in spaced juxtaposition with the panel means for forming a second storage compartment between said panel means and lid means, said second storage compartment being substantially equal in length and width to the first storage compartment.

2. The storage container defined in claim 1 including latch means for latching the panel means in spaced juxtaposition with the base when forming said first storage compartment.

3. The storage container defined in claim 1 including latch means for latching the lid means in spaced juxtaposition with the panel means when forming said second storage compartment.

4. The storage container defined in claim 1 including a living hinge for pivotally mounting the panel means with respect to the base.

5. The storage container defined in claim 1 including a living hinge for pivotally mounting the lid means with respect to the base.

6. The storage container defined in claim 1 including a pair of spaced parallel sidewalls; and in which said sidewalls and end walls define the periphery of the first storage compartment.

7. The storage container defined in claim 1 in which the panel means includes a generally flat panel; and in which partition means is formed on the panel for dividing the second compartment into compartment sections when the panel means is in juxtaposition with the base.

8. The storage container defined in claim 1 in which the base, panel means and lid means are formed as a one-piece member of transparent plastic material.

9. The storage container defined in claim 1 in which the panel means and lid means are pivotally mounted on opposite ends of the base and movable into overlapping juxtaposition with each other and with the base, whereby said first and second compartments are stacked one on the other.

10. A storage container for objects including a base having a pair of spaced parallel sidewalls and an end wall formed integrally with the base, wherein said walls define a periphery of a first storage compartment;

panel means pivotally mounted with respect to the base and movable into spaced juxtaposition with said base for forming the first storage compartment between said base and panel;

lid means pivotally mounted with respect to the base and movable into a closed position on the base in spaced juxtaposition with the panel means for forming a second storage compartment between said panel means and lid means; and said panel means including a generally flat planar panel, an outwardly extending projection, and a hinge located opposite of said projection for pivotally mounting said panel with respect to the base for moving said panel into spaced parallel juxtaposition with the base, said projection engaging the base to orient said panel in its spaced parallel relationship with said base to form the first storage compartment therebetween.

11. The storage container defined in claim 10 in which the panel projection is provided by an end wall; and in which said end wall lies adjacent to and within the end wall of the base when said panel is moved into spaced juxtaposition with the base.

12. The storage container defined in claim 10 in which an opening is formed in the panel to enable said panel to be griped for movement of the panel from the spaced juxtaposition with the base toward an open position.

13. A storage container for objects including a base having a pair of spaced parallel sidewalls and an end wall formed integrally with the base, wherein said walls define a periphery of a first storage compartment;

panel means pivotally mounted with respect to the base and movable into spaced juxtaposition with said base for forming the first storage compartment between said base and panel;

lid means pivotally mounted with respect to the base and movable into a closed position on the base in spaced juxtaposition with the panel means for forming a second storage compartment between said panel means and lid means, said lid means including a generally flat lid, a pair of spaced parallel sidewalls, and an end wall formed on said lid;

a hinge pivotally mounting the lid on the end wall of the base; and said lid sidewalls lying adjacent to and outside of the base sidewalls when the lid means is in the closed position.

14. The storage container defined in claim 13 in which the end wall of the lid means is inclined with respect to the lid.

15. The storage container defined in claim 14 in which printed indicia is mounted on the inclined end wall of the lid.

* * * * *